US006865858B1

(12) United States Patent
Pollard

(10) Patent No.: US 6,865,858 B1
(45) Date of Patent: Mar. 15, 2005

(54) STRUCTURAL PROTECTION DEVICE AND METHOD OF INSTALLING THE SAME

(76) Inventor: Marc T. Pollard, 1606 Berne Altamont Rd., Altamont, NY (US) 12009

( * ) Notice: Subject to any disclaimer, the term of this patent is extended or adjusted under 35 U.S.C. 154(b) by 0 days.

(21) Appl. No.: 09/559,473

(22) Filed: Apr. 27, 2000

(51) Int. Cl.[7] ..... E04C 2/38

(52) U.S. Cl. ..... 52/716.2; 52/97; 52/58; 52/287.1

(58) Field of Search ..... 52/97, 58, 105, 52/410, 741.3, 731.1, 716.2, 177, 180, 181, 287.1

(56) References Cited

U.S. PATENT DOCUMENTS 1,091,214 A * 3/1914 Gruber
2,674,765 A 4/1954 Tennison
3,093,216 A * 6/1963 Dunham
4,742,654 A 5/1988 Cole
4,848,049 A 7/1989 Hanson
4,858,399 A 8/1989 Salato, Jr.
5,009,045 A * 4/1991 Yoder
5,148,644 A * 9/1992 Weir ..... 52/300
5,280,692 A * 1/1994 Patey
5,303,523 A 4/1994 Hand et al.
5,839,250 A * 11/1998 Hibler ..... 52/746.1
5,913,784 A * 6/1999 Hite
6,108,992 A * 8/2000 Shaw
6,250,042 B1 * 6/2001 Rudd ..... 52/731.8
6,295,780 B1 * 10/2001 Thompson
6,295,781 B1 * 10/2001 Thompson

* cited by examiner

*Primary Examiner*—Carl D. Friedman
*Assistant Examiner*—Chi Q. Nguyen
(74) *Attorney, Agent, or Firm*—Schmeiser, Olsen & Watts

(57) ABSTRACT

A device which covers an underlying structural member, which protects both the underlying and overlaying structural members from rotting and/or corrosion resulting from prolonged exposure to moisture, such as water, ice, snow, fluids, etc. The device includes a base, mounted between the overlaying and underlying structural members, and a pair of flanges extending outwardly therefrom. The device further includes a plurality of moisture removal features which assist in the removal of moisture located between the overlaying and underlying structural members. The moisture removal features may be formed in parallel with the edge of the flanges, or at a desired angle therefrom.

3 Claims, 6 Drawing Sheets

STRUCTURAL PROTECTION DEVICE AND METHOD OF INSTALLING THE SAME

BACKGROUND OF THE INVENTION

1. Technical Field

The present invention relates generally to a device for protecting structural members from damage resulting from prolonged exposure to moisture.

2. Related Art

Underlying structural members, e.g., wood and metal beams, joists, trusses, etc., as well as overlaying structural members, e.g., flooring, roofing, etc., are quite susceptible to rotting and corrosion due to prolonged exposure to moisture, such as rain, snow, ice, fluids, beverages, liquids, water, etc. For instance, moisture often seeps down into the crevices between the deck flooring, or roofing, that overlays the underlying structural members. Similarly, moisture may run along the nail or screw holes which secure the overlaying structural member to the underlying structural member. Moisture that remains between the overlaying and underlying structural members eventually leads to rotting and corrosion of both members. Furthermore, if the moisture is not directed off the surface of the underlying structural member it may also lead to the creation of internal stresses within and between the underlying and overlaying structural members, for example, due to the freezing of the moisture trapped therebetween. Additionally, moisture rolling off the top surface of the underlying structural member runs down the sides of the member, causing further rotting or corrosion of the member. Prolonged exposure to moisture typically causes deterioration of both the overlaying and underlying structural members, thereby weakening the overall structure with time.

Accordingly, there exists a need in the industry for a device that protects both the overlaying and underlying structural members from degradation as a result of this type of prolonged exposure to moisture.

SUMMARY OF THE INVENTION

The present invention provides a device capable of protecting an overlaying and underlying structural member from prolonged exposure to moisture, thereby reducing the amount of corrosion and rotting of the members, and a method of installing the device.

The first general aspect of the present invention provides a structural protection device, comprising: a base; and a pair of extensions extending from the base, wherein the extensions include at least one moisture removal feature. This aspect provides a device designed to protect overlaying and underlying structural members from rotting and corrosion due to prolonged exposure to moisture. In particular, the device includes a base that covers the top surface of the underlying structural member to prevent moisture from contacting the top surface of the underlying structural member. The device further includes a pair of extensions or flanges that extend from the base of the device, which prevent moisture, such as water, running off the top surface of the underlying structural member from contacting the side surfaces of the underlying structural member. The device further includes a plurality of moisture removal features located on or within the flanges and optionally on or within the base. The moisture removal features encourage and assist in directing moisture off the base of the device and away from both the overlaying and underlying structural members. Without these moisture removal features the moisture could remain between the overlaying and underlying structural members, rather than being directed to the ground, which could lead to numerous problems. For example, moisture remaining between the overlaying and underlying structural members may rot or corrode the members, and internal stresses may be created within and between the structural members in the event the moisture freezes, etc.

The second general aspect of the present invention provides a method of installing a structural protection device, comprising the steps of: providing a first structural member; placing a substantially flat structural protection device over the first structural member; and directing a pair of extensions of the structural protection device toward the first structural member. This aspect provides a method of installing the device, wherein the device may be manufactured in a flat sheet, having fold lines therein. In particular, the flat sheet may be measured and cut to the appropriate length with the aid of measurement indicators or markings on the device. The flat sheet may alternatively be manufactured in standard size pre-cut sheets. The flat sheet may then be placed on the underlying structural member, and optionally fastened thereto. The sides of the device are then bent toward the underlying structural member, creasing at the fold lines, thereby forming a pair of flanges. The overlaying structural member may then be placed over the device covered underlying structural member and fastened thereto.

The third general aspect of the present invention provides a structural protection device comprising: a substantially flat sheet having a pair of extensions each separated from a base by a pair of fold lines. This aspect provides a device, having similar advantages as those associated with the first aspect in a pre-installation condition.

The foregoing and other features and advantages of the invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like members, and wherein.

DESCRIPTION OF THE PREFERRED EMBODIMENTS

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. Although the drawings are intended to illustrate the present invention, the drawings are not necessarily drawn to scale.

Figure 1:
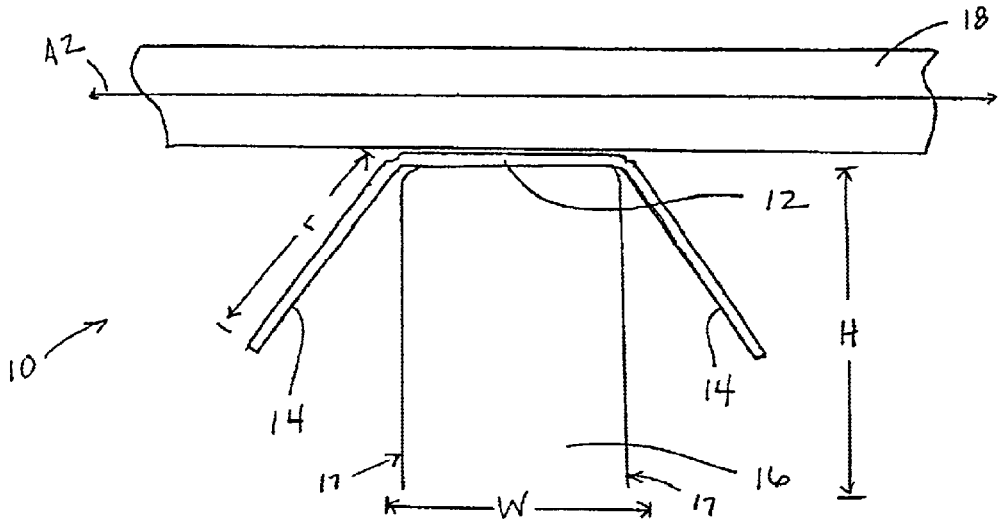
FIG. 1 depicts a front view of a structural protection device assembled between an underlying structural member and an overlaying structural member, in accordance with the present invention.

Referring to the drawings, FIG. 1 shows a structural protection device 10 in accordance with the present invention. In particular, the device 10 is constructed of a mounting surface or base 12, and a pair of flanges or extensions 14. The device 10 may be constructed out of any water resistant or water repellant material, such as plastic, metal, rubber, a metal alloy, etc.

Figure 2:
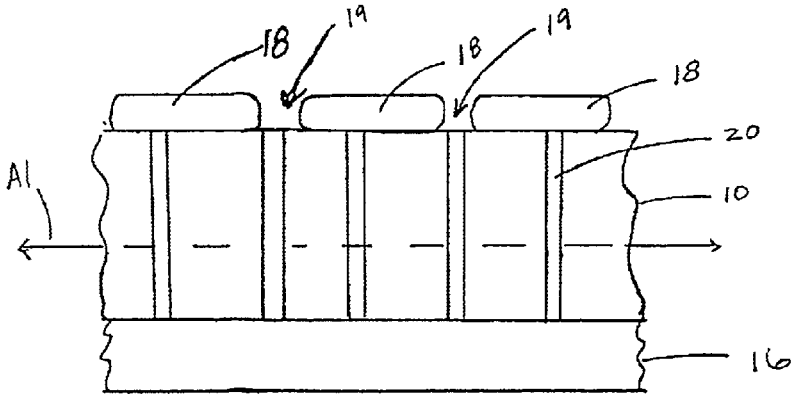
FIG. 2 depicts a side view of the device of FIG. 1, in accordance with the present invention.

The base 12 fits over a first or underlying structural member 16, such as a truss, deck beam, joist, etc. The underlying structural member 16 may be a single member, as depicted in FIG. 1, or multiple members adjacent and/or affixed to one another. The longitudinal axis A1 of both the device 10 and the underlying structural member 16 are substantially in parallel with one another, as illustrated in FIG. 2. The base 12 covers and protects the top surface of the underlying structural member 16 from exposure to moisture that seeps through the nail holes and/or crevices 19 between the overlaying structural member 18. The flanges 14 direct moisture running off the top surface of the underlying structural member 16 away from the sides 17 of the underlying structural member 16 (FIG. 1).

The base 12 of the device 10 may optionally be attached to the underlying structural member 16 via a fastening device (not shown), such as nails, bolts, staples, adhesives, etc., to assist the user in maintaining a desired placement of the device 10 during installation. A second or overlaying structural member 18, such as wood or metal roofing, flooring, decking, etc., is thereafter mounted over the underlying structural member 16 and the device 10. In this example, the longitudinal axis A1 of the underlying structural member 16 and the device 10 is substantially perpendicular to the longitudinal axis A2 of the overlaying structural member 18 (refer to FIGS. 1 and 2). It should be noted that the longitudinal axis A1, A2 of the underlying structural member 16 and the overlaying structural member 18, respectively, may be positioned in various arrangements relative to one another. For instance, the overlaying structural member 18 may be fastened at an angle relative to the underlying structural member 16. Likewise, the overlaying structural member 18 may be fastened substantially in parallel with the underlying structural member 16, and so on. Regardless of the orientation of the overlaying structural member relative to the underlying structural member 16, the device 10 protects the overlaying and underlying structural members 18, 16 in the same manner.

The device 10 may be formed having various dimensions designed to fit the particular application based on the dimensions of the underlying structural member 16. For instance, referring again to FIG. 1, the base 12 of the device 10 may be formed having a width W of 2, 4, 6, 8 inches, etc., depending upon the width W of the underlying structural member 16. Furthermore, the length L of the flanges 14 may be varied depending upon the height H of the underlying structural member 16.

The device 10 preferably includes a plurality of moisture directing or removal features 20. The moisture removal features 20, formed via molding, etching, routing, stamping, etc., direct the moisture from the top surface of the base 12, as well as away from the sides 17 of the underlying structural member 16 (see FIG. 1). Furthermore, the moisture removal features 20 may optionally extend along the top surface of the base 12, thereby initiating the removal of moisture from the top surface rather than allowing moisture to sit between the overlaying and underlying structural members 18, 16, which if left long enough leads to rotting or corrosion. In this manner, moisture falling between the crevices 19 of the overlaying structural members 18 (FIG. 2) will be directed away from the underlying structural member 16.

Figure 3A:
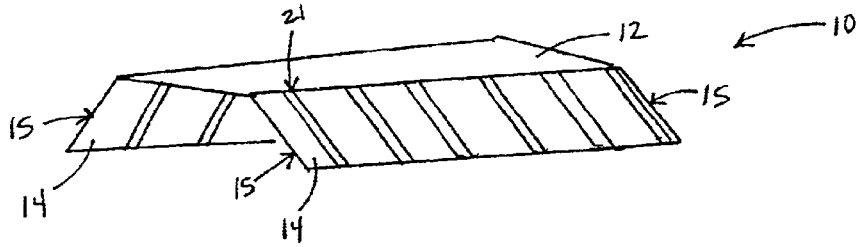
FIG. 3*a* depicts a perspective view of the device having a plurality of moisture removal features, in accordance with the present invention.
Figure 4A:
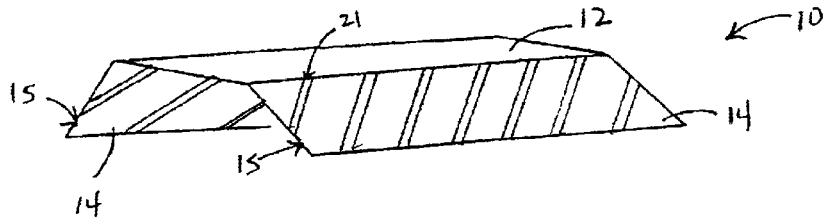
FIG. 4*a* depicts a perspective view of the device having a plurality of moisture removal features, in accordance with the present invention.
Figure 5:
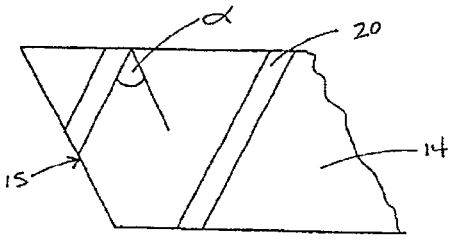
FIG. 5 depicts the angular placement of the moisture removal features of FIG. 4, in accordance with the present invention.
Figure 7:
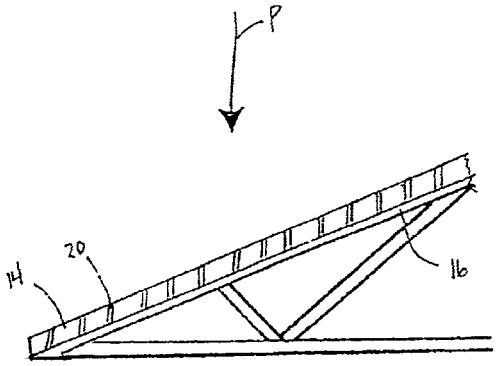
FIG. 7 depicts a side view of the device of FIG. 4 used in conjunction with a truss, in accordance with the present invention.

The moisture removal features 20 may take various forms. FIG. 3*a* shows a first embodiment, wherein the moisture removal features 20 extend along the flanges 14 and run substantially in parallel with the edge 15 of the flanges 14. In the alternative, the moisture removal features 20 may extend diagonally along the flanges 14, as depicted in FIG. 4*a*. In particular, the moisture removal features 20 of FIG. 4*a* may formed at an angle $\propto$ from the edge 15 of the flange 14, as shown in more detail in FIG. 5. The angled moisture removal features 20 are particularly advantageous for use with sloped structural members 16, such as trusses, etc., as illustrated in FIG. 7, wherein the moisture falls toward the ground in the direction of arrow P. The device 10 may be made having moisture removal features 20 formed at various angles ∝ in order to conform to the slope of the underlying structural member 16.

Figure 3B:
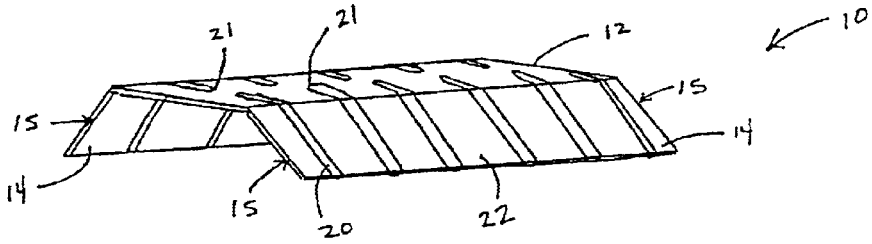
FIG. 3*b* depicts a perspective view of the device having a plurality of moisture removal features, in accordance with the present invention.
Figure 4B:
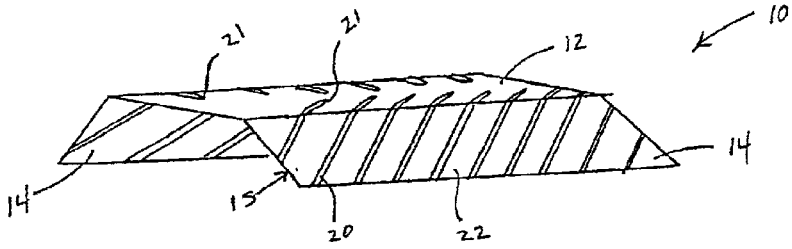
FIG. 4*b* depicts a perspective view of the device having a plurality of moisture removal features, in accordance with the present invention.
Figure 3C:
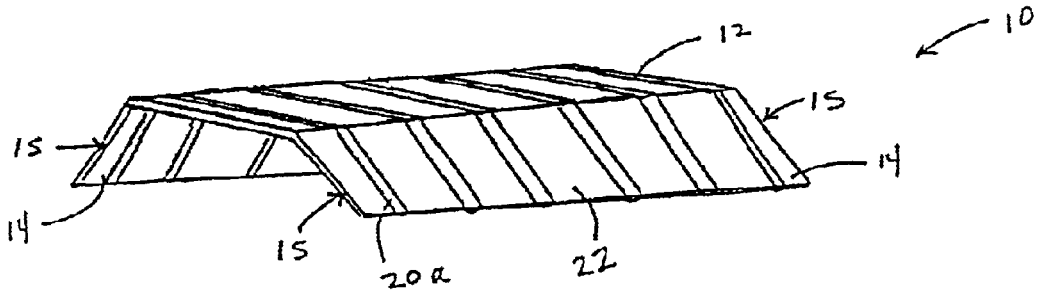
FIG. 3*c* depicts a perspective view of the device having a plurality of moisture removal features, in accordance with the present invention.
Figure 4C:
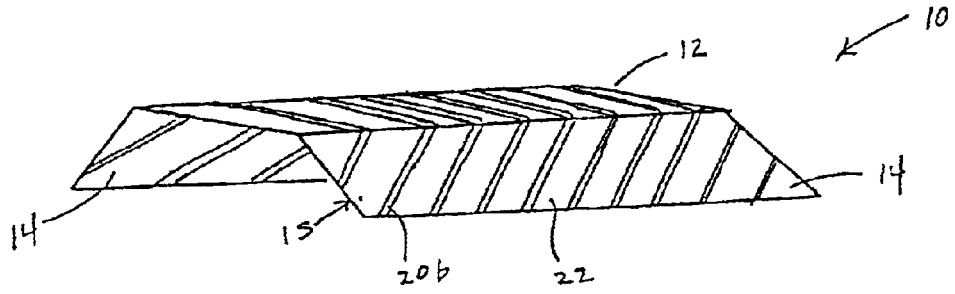
FIG. 4*c* depicts a perspective view of the device having a plurality of moisture removal features, in accordance with the present invention.
Figure 6A:
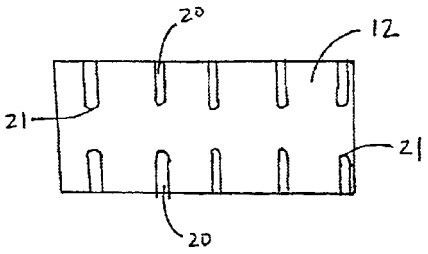
FIG. 6*a* depicts a top view of the base of the device, in accordance with the present invention.
Figure 6B:
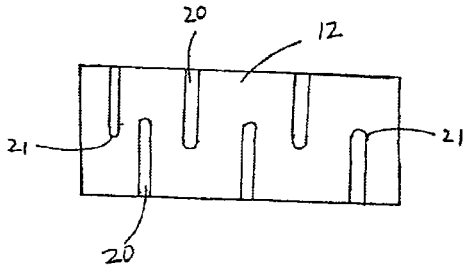
FIG. 6*b* depicts a top view of the base of the device, in accordance with the present invention.
Figure 6C:
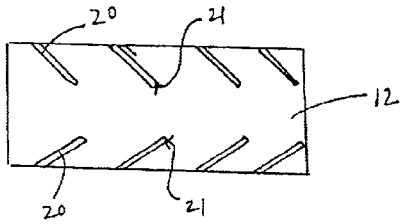
FIG. 6*c* depicts a top view of the base of the device, in accordance with the present invention.
Figure 6D:
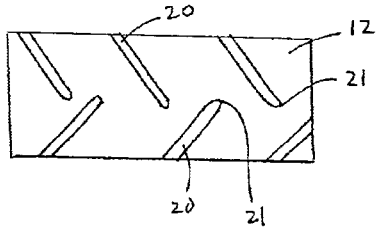
FIG. 6*d* depicts a top view of the base of the device, in accordance with the present invention.

The moisture removal features 20 may optionally extend along the top surface of the device 10, namely, along the base 12, as illustrated in FIGS. 3*b* and 4*b*. The ends 21 of the moisture removal features 20 may extend along the top surface of the base 12 to different lengths. For example, FIG. 6*a* shows a top view of the base 12 having a plurality of moisture removal features 20 extending only partially thereover. The ends 21 of the moisture removal features 20 may be long enough to alternatively overlap one another, as illustrated in FIG. 6*b*. The ends 21 of the moisture removal features 20 may also extend along the top surface of the base 12 at an angle, as illustrated in FIGS. 6*c* and 6*d*. Alternatively, the ends 21 of the moisture removal features 20 may also meet on the top surface of the device 10, thereby forming a plurality of continuous moisture removal features 20 that run from one flange 14 to the other, as illustrated in FIGS. 3*c* and 4*c*.

Figure 8A:
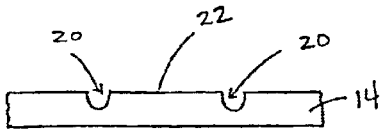
FIG. 8*a* depicts the moisture removal features, in accordance with the present invention.
Figure 8B:
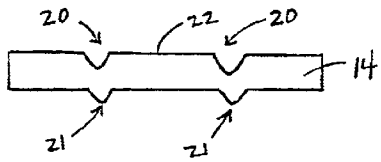
FIG. 8*b* depicts the moisture removal features, in accordance with the present invention.
Figure 8C:
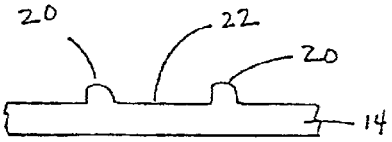
FIG. 8*c* depicts the moisture removal features, in accordance with the present invention.
Figure 8D:
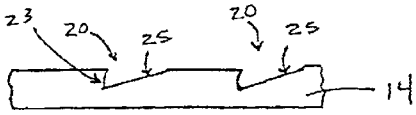
FIG. 8*d* depicts the moisture removal features, in accordance with the present invention.

The moisture removal features 20 may take a variety of shapes, sizes and configurations, none of which are intended to be limited by the examples included herein. For example, as shown in FIG. 8*a*, the moisture removal features 20 may be concave slots or channels in the top surface 22 of the device 10. In this manner, the moisture removal features 20 act as conduits which allow the moisture to flow therein, rather than flowing along the top surface 22 of the flange 14. Similarly, the moisture removal features 20 may be stamped or formed as depicted in FIG. 8*b*. In the alternative, the moisture removal features 20 may be raised ribs, as shown in FIG. 8*c*, which direct the flow of moisture along the wider surface 22. Furthermore, the moisture removal features 20 may consist of a slanted portion or ramp 25 which leads into a channel 23, wherein the ramp 25 directs the flow of the moisture into the channels 23, as shown in FIG. 8*d*. The ramp 25 further assists in directing the moisture away from the underlying and overlaying structural members 16, 18.

Figure 9:
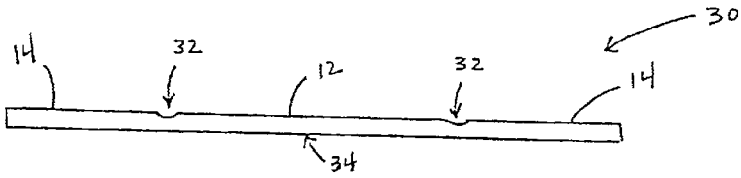
FIG. 9 depicts an end view of the device prior to mounting, in accordance with the present invention.
Figure 10:
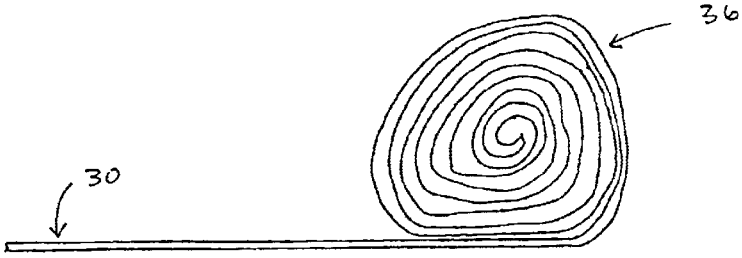
FIG. 10 depicts a cross-sectional view of a roll of the device, in accordance with the present invention.
Figure 11:
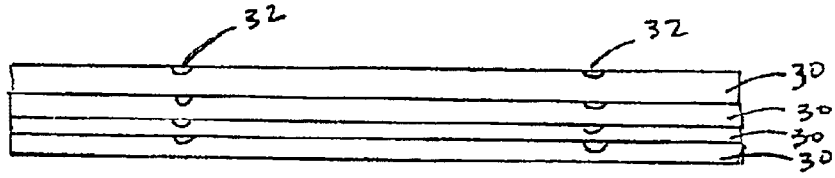
FIG. 11 depicts an end view of a plurality of devices stacked for ease of storage and transportation, in accordance with the present invention.

A second aspect of the present invention provides a method of manufacturing, transporting and installing the device 10. First, the device 10 may be manufactured in a flat sheet 30, as depicted in FIG. 9, having fold lines 32 formed therein, which assist in installation. The fold lines 32, may be creases, perforations, etc. It should be noted that the fold lines 32 may be formed during the formation of the moisture removal features 20 to cut down on manufacturing time and costs. The flat sheet 30 may be consolidated into rolls 36 for ease of storage and transportation, as shown in FIG. 10. Likewise, the flat sheets 30 may be cut into standard length sheets, such as 4', 6', 8', 10', 12', etc., and stacked for ease of storage and transportation, as illustrated in FIG. 11.

To install the device 10, the length of the underlying structural member 16 is measured. The appropriate length of the device 10 is selected, or the roll 36 is then un-wrapped to expose the amount of flat sheet 30 needed to cover the length of the underlying structural member 16. The exposed portion of the flat sheet 30 is then cut to the appropriate length. In the alternative, the device 10, either from the stack (FIG. 11) or from the roll 36 (FIG. 10), may be placed adjacent the underlying structural member 16 and cut to the appropriate size. The under side 34 of the base 12 is placed on the structural member 16. Again, the base 12 of the device 10 may optionally be fastened to the underlying structural member, via nails, bolts, staples, screws, adhesives, etc. (not shown). The flanges 14 are then gently pushed downward, bending at the fold lines 32, to form the device 10 illustrated in FIG. 1.

Figure 12:
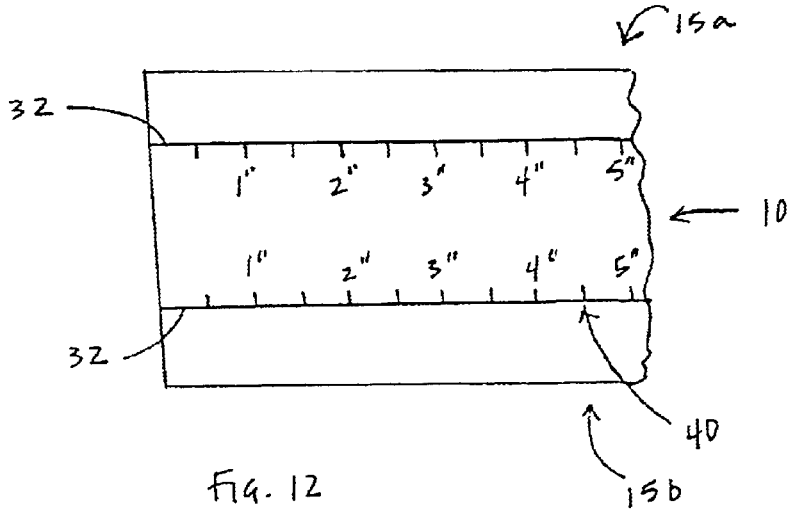
FIG. 12 depicts a top view of the device having a plurality of measured markings thereon, in accordance with the present invention.
Figure 13:
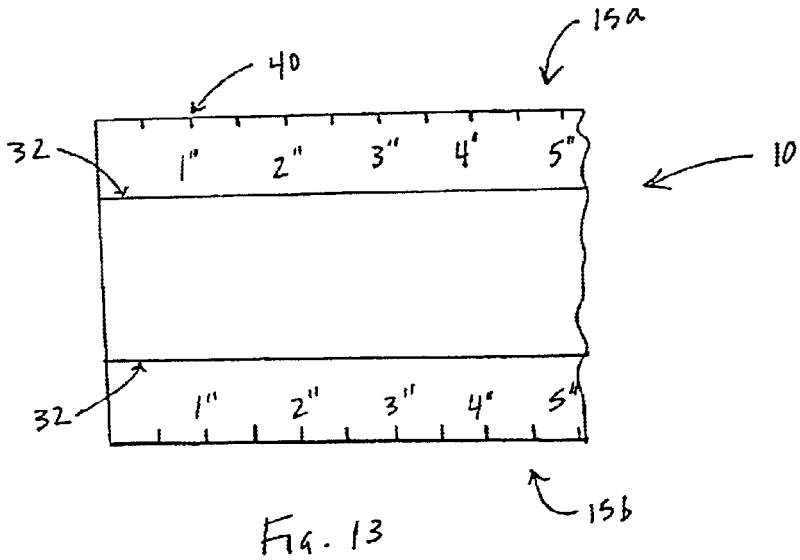
FIG. 13 depicts a top view of the device having a plurality of measured markings thereon, in accordance with the present invention.

To further aid in the installation of the device 10 may be manufactured having a plurality of markings 40, similar to a ruler or other measuring device, on a surface (either the inner or outer surface) of the device 10, as illustrated in FIGS. 12 and 13. The markings 40 may be located on the flanges 14 or on the base 12 (FIGS. 12 and 13, respectively), or both. The markings 40 may assist the user in measuring the appropriate length of the device 10 needed to cover the underlying structural member 16. The markings 40 may also assist the user in cutting the device 10 along a straight edge by lining up the matching measurements on the first and second side 15*a*, 15*b* of the device 10.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

I claim:

1. A structural protection device comprising:

a substantially flat sheet including a base, a pair of extensions extending from the base in the same plane as the base, and a pair of fold lines at the intersection of the base and the extensions, wherein the extensions further comprise a plurality of moisture removal features angularly displaced from a side of the extensions.

2. The structural protection device of claim 1, wherein the flat sheet is rolled for ease of transportation.

3. The structural protection device of claim 1, wherein a plurality of flat sheets are stackable for ease of transportation.

* * * * *